US008240523B2

(12) United States Patent
Goulet

(10) Patent No.: US 8,240,523 B2
(45) Date of Patent: Aug. 14, 2012

(54) CAP WITH RECESSED PORTION

(75) Inventor: Richard Goulet, Toronto (CA)

(73) Assignee: Shrader Canada Limited, Oakville (CA)

( * ) Notice: Subject to any disclaimer, the term of this patent is extended or adjusted under 35 U.S.C. 154(b) by 523 days.

(21) Appl. No.: 12/131,683

(22) Filed: Jun. 2, 2008

(65) Prior Publication Data

US 2008/0296416 A1 Dec. 4, 2008

Related U.S. Application Data

(60) Provisional application No. 60/941,802, filed on Jun. 4, 2007.

(51) Int. Cl.
*B67D 7/06* (2010.01)

(52) U.S. Cl. ..... 222/538; 222/182; 222/402.1

(58) Field of Classification Search ..... 222/182, 222/402.1, 402.13, 538, 530
See application file for complete search history.

(56) References Cited

U.S. PATENT DOCUMENTS

| | | | | | |
|---|---|---|---|---|---|
| 3,642,179 | A * | 2/1972 | Micallef | 222/402.12 |
| 4,520,951 | A * | 6/1985 | Facey | 222/182 |
| 4,728,007 | A * | 3/1988 | Samuelson et al. | 222/182 |
| 4,819,838 | A * | 4/1989 | Hart, Jr. | 222/538 |
| 5,143,263 | A * | 9/1992 | Newell | 222/538 |
| 5,823,405 | A * | 10/1998 | Benns | 222/538 |
| 6,315,152 | B1 * | 11/2001 | Kalisz | 220/735 |
| 6,412,671 | B1 * | 7/2002 | Riley et al. | 222/538 |
| 6,796,464 | B1 * | 9/2004 | Tung | 222/402.17 |
| 6,910,608 | B2 * | 6/2005 | Greer et al. | 222/538 |

* cited by examiner

*Primary Examiner* — Kevin P Shaver
*Assistant Examiner* — Daniel R Shearer
(74) *Attorney, Agent, or Firm* — Brett J. Slaney; John R. S. Orange; Blake, Cassels & Graydon LLP

(57) ABSTRACT

A cap for an aerosol can is provided comprising a recessed portion configured to retain a sprayer for the can wherein the sprayer is contained in the recessed portion when stored in the cap. The sprayer comprises a button actuator to attach to the valve of the can and a spray nozzle extension for the button to provide additional control. The button includes a sleeve for fitting over a protruding post in the recessed portion to align the sprayer in the recessed portion. The recessed portion may also include a support with a notch for aligning the nozzle in the channel provided by the recessed portion.

15 Claims, 10 Drawing Sheets

CAP WITH RECESSED PORTION

This application claims priority from U.S. Provisional Application No. 60/941,802 filed on Jun. 4, 2007, the contents of which are incorporated herein by reference.

TECHNICAL FIELD

The following relates generally to closures for containers and has particular utility in caps for cans containing pressurized matter.

BACKGROUND

There are many products that are packaged or contained under pressure in a can, with a device for releasing the product as a spray. Such products are commonly referred to as aerosols. Typical aerosol containers comprise a cylindrical can with a valve at the top which, when pressed, releases an aerosol spray or mist. To prevent inadvertent release of the contents during packaging, shipping, storage etc., the valve is typically protected by a cap secured atop the can and over the valve. To assist in operation of the valve, a actuator such as a button and/or nozzle can be secured over the opening of the valve. The actuator provides an easy mechanism for the user to control operation of the valve.

A common actuator is a cylindrically shaped button that redirects the spray in a direction perpendicular to the axis of the can from which the contents are being expelled. To further assist the user in directing the aerosol spray, a tube or other extension may be provided that fits with the button and extends well beyond the rim of the can. As a result, the tube often cannot remain secured to the actuator or button when the cap covers the can and must be removed. To enable the tube to be shipped with the can, it is often attached to the exterior of the can with a removable adhesive strip or 'tape'. For other products, where a more sophisticated nozzle attachment is used, the nozzle attachment may be seated in a slot in the cap.

When the nozzle is attached to the cap, it protrudes from the can thus possibly increasing the volume of the package required to be shipped and/or creating difficulties in packaging if the nozzles are not aligned to minimize interference with each other. Moreover, during assembly, the protruding nozzle can create difficulties in an automated production line, in particular where the caps are sent through a tumbler and should be able to roll freely over themselves.

When a tube is attached to the side of the can, it can be lost during shipping or when stored and/or moved around and can be easily misplaced by the eventual user or customer, especially when the adhesive tape becomes ineffective or is removed.

It is an object of the following to obviate or mitigate the above-noted disadvantages.

SUMMARY

A cap for an aerosol can is provided comprising a recessed portion configured to retain a sprayer for the can wherein the sprayer is contained in the recessed portion when stored in the cap.

BRIEF DESCRIPTION OF THE DRAWINGS

An embodiment of the invention will now be described by way of example only with reference to the appended drawings wherein.

DETAILED DESCRIPTION OF THE DRAWINGS

Figure 1:
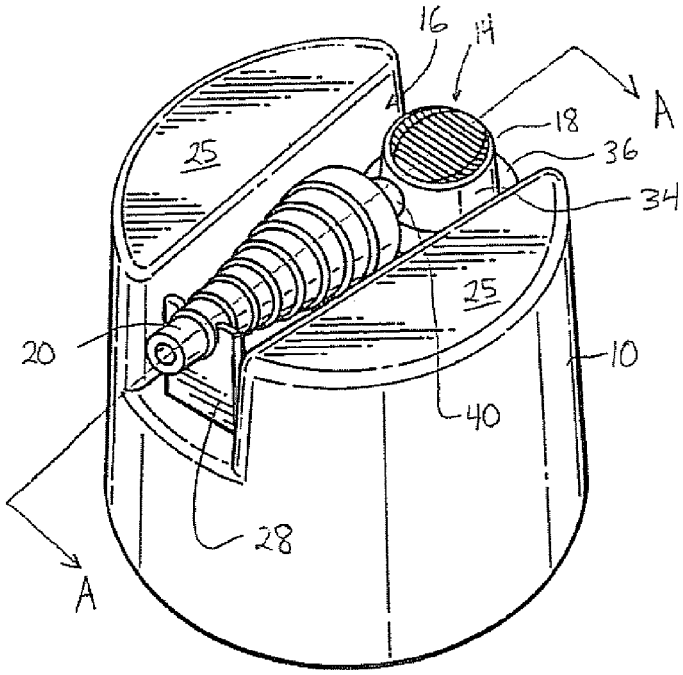
FIG. 1 is a perspective assembly view of one embodiment of a cap with a recessed portion and stored sprayer.

Referring now to FIGS. 1-6, a cap 10 is shown for covering an aerosol can 12, the cap 10 being configured for storing/retaining a sprayer 14 within a recessed portion 16 thereof. The sprayer 14 generally comprises a spray tube 20 attached to an actuator or 'button' 18.

Figure 7:
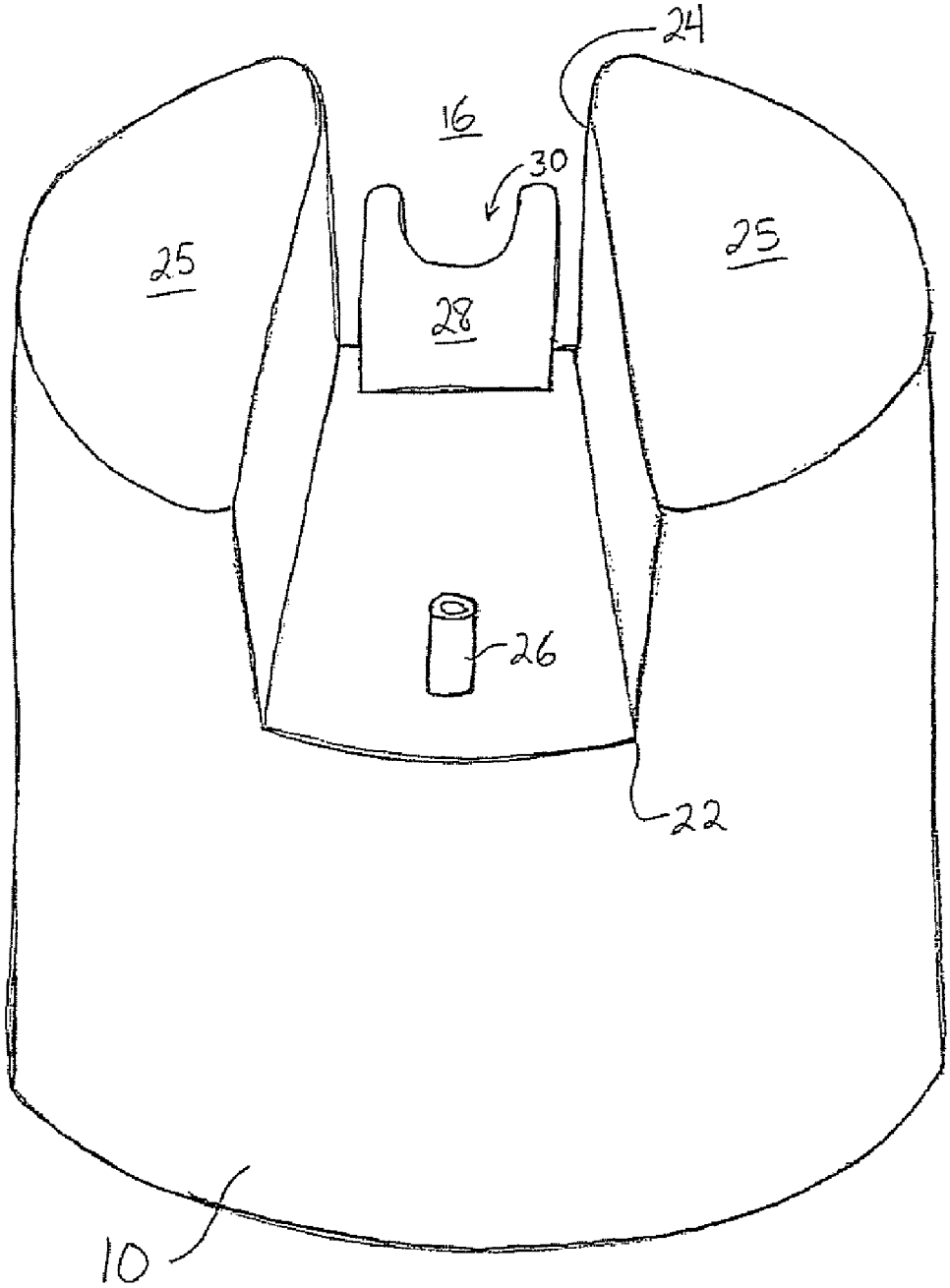
FIG. 7 is a perspective view of the cap shown in FIG. 1.
Figure 8:
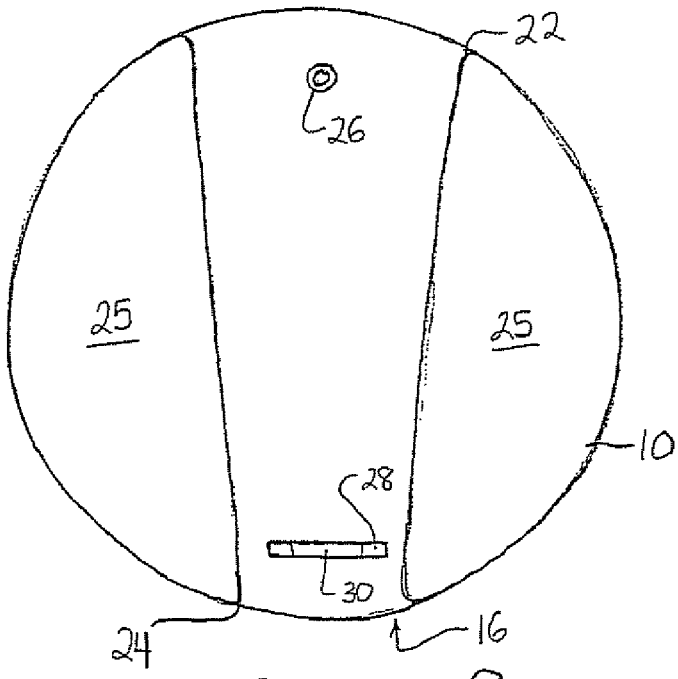
FIG. 8 is a top plan view of the cap shown in FIG. 7.
Figure 9:
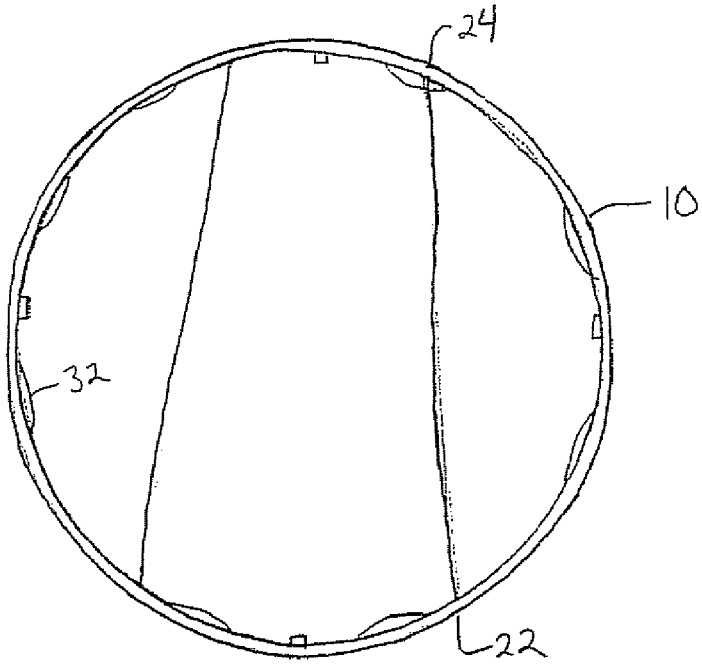
FIG. 9 is a bottom plan view of the cap shown in FIG. 7.
Figure 10:
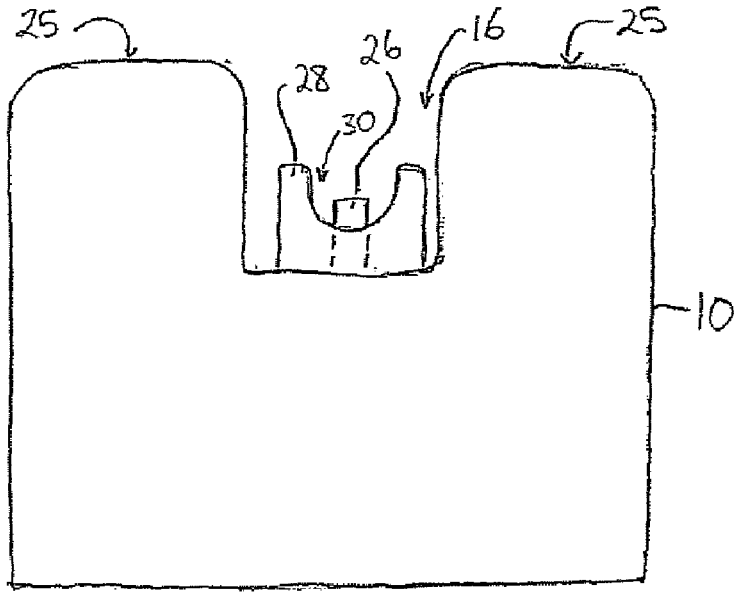
FIG. 10 is a front elevation view of the cap shown in FIG. 7.
Figure 11:
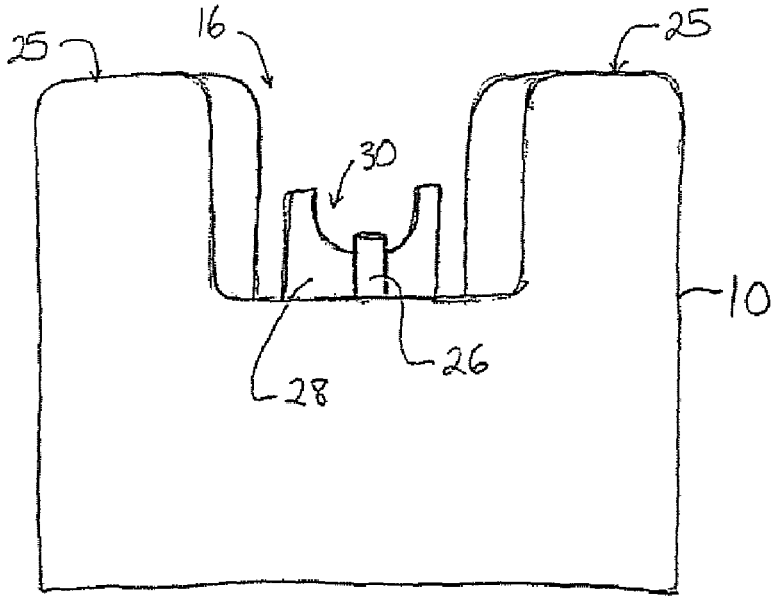
FIG. 11 is a rear elevation view of the cap shown in FIG. 7.

The cap 10 is shaped according to the shape of the can 12 and thus is typically cylindrically shaped and sized to fit snugly over the top rim of the can 12. The cap 10 is shown in isolation in FIGS. 7-11. As best seen in FIGS. 7 and 8, the recessed portion 16 is formed as a tapered channel between a pair of opposite side portions 25 of the same height, the channel 16 having a wide end 22 and a narrow end 24. Situated at the wide end 22 is a protruding cylindrical post 26 used to position the button 18 within the recessed portion 16. Situated at the narrow end 24 is a raised support 28 having a semi-circular notch 30 for supporting and aligning the spray tube 20 within the recessed portion 16. It will be appreciated that the recessed portion 16 may also be closed at any one or both of the ends 22, 24 but is preferably an open-end channel (as shown) to facilitate attachment and removal of the sprayer 14. It will also be appreciated that the recessed portion 16 may instead be rectangular and does not require the taper shown. The taper may be included for aesthetic reasons or to generally follow the shape of the sprayer 14 to optimize the size of the channel 16 etc., as desired.

To facilitate securing the cap 10 to the can 12, the interior thereof comprises a series of protrusions 32 (best shown in FIGS. 9 and 16), which frictionally engage the outer surface of the can 12 to secure the cap 10 in place. The cap 10 is generally configured such that the recessed portion 16 completely contains the sprayer 14 when assembled as shown in FIG. 1.

Figure 6:
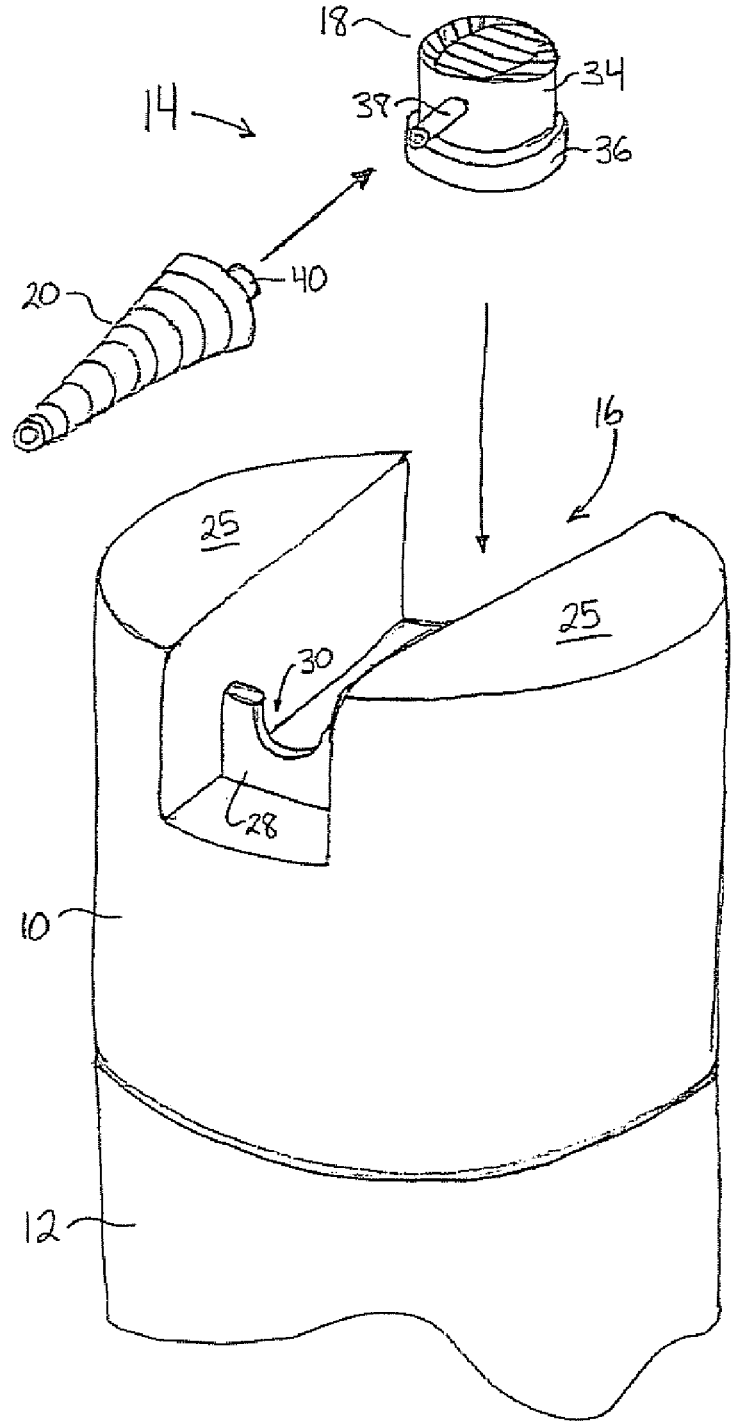
FIG. 6 is an exploded perspective view of the embodiment of FIG. 1.
Figure 12:
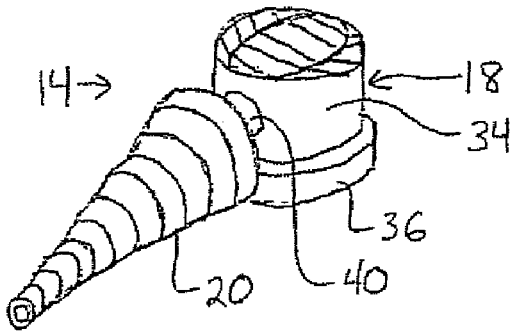
FIG. 12 is a perspective view of the sprayer shown in FIG. 1.
Figure 13:
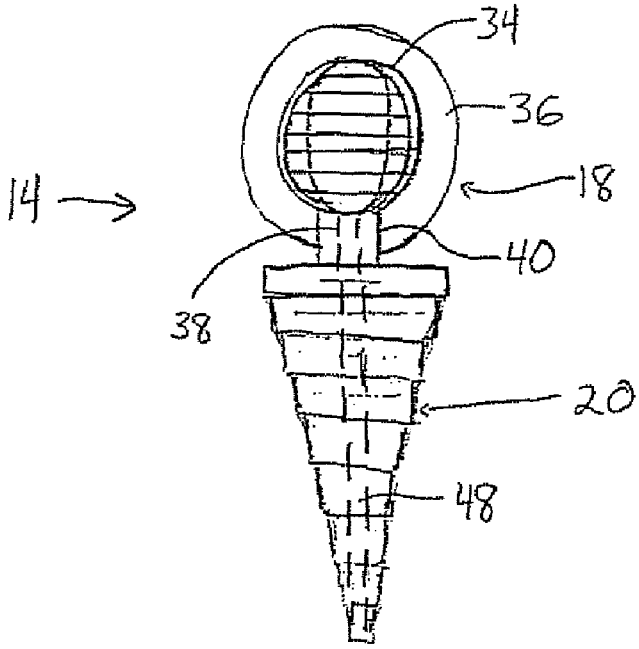
FIG. 13 is a top plan view of the sprayer shown in FIG. 12.
Figure 14:
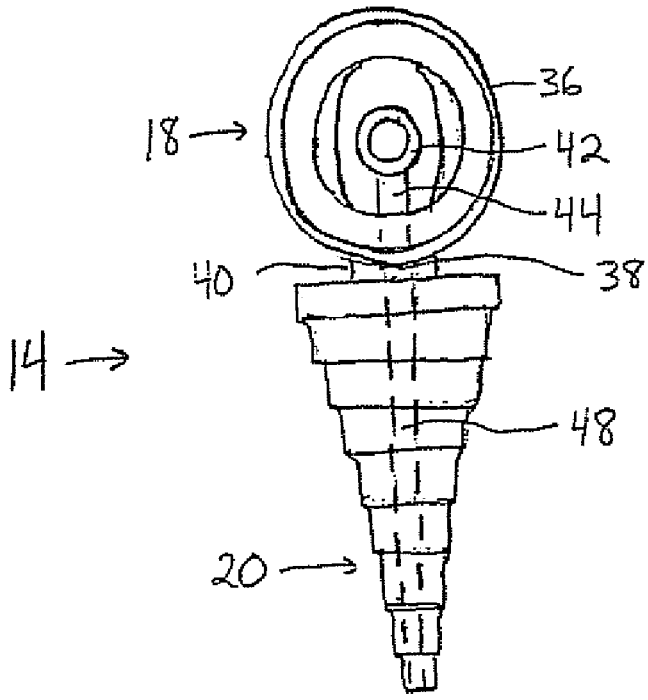
FIG. 14 is a bottom plan view of the sprayer shown in FIG. 12.

As can be seen in the exploded view in FIG. 6, The sprayer 14 is assembled from the actuator or button 18 and the detachable spray nozzle 20. In the embodiment shown in FIGS. 1-6, the spray nozzle 20 is formed as a circumferentially ribbed cone, which facilitates insertion of the free end of nozzle 20 into a hose or other opening, especially those that are flexible. The sprayer 14 is shown in isolation in FIGS. 12-15. The sprayer 14 is also shown in section and in situ when stored in the cap 10 in FIG. 16, and in situ when attached to the can 12 in FIG. 17. The button 18 comprises a generally cylindrical body 34 with a circumferential flange 36 protruding from a lower portion of the body 34. The body 34 may comprise a contoured, knurled upper surface as shown in FIG. 12 to provide a grip for the user and to better accommodate the user's thumb or finger.

Figure 16:
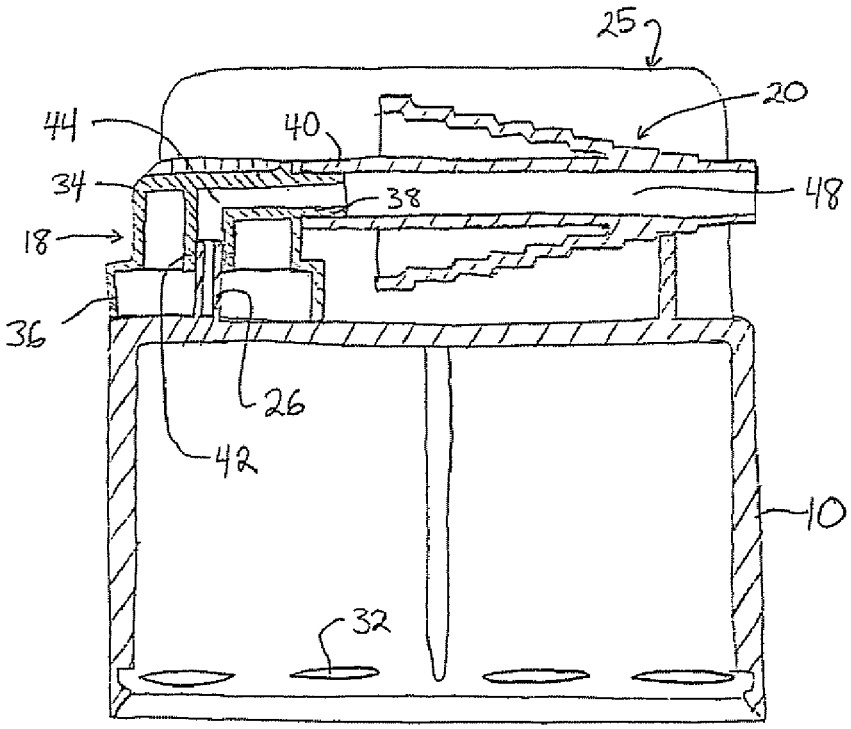
FIG. 16 is a sectional view of the assembly shown in FIG. 1 along the line A-A in FIG. 1.
Figure 17:
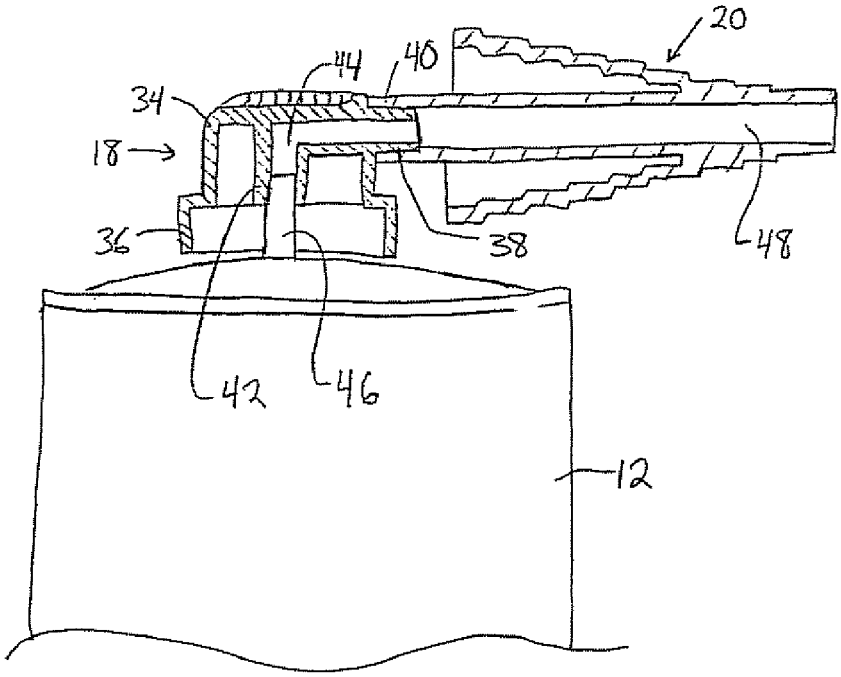
FIG. 17 shows the sectioned sprayer of FIG. 16 attached to an aerosol can.

As can be seen in FIGS. 6, 16 and 17, the button 18 includes a projection 38 comprising an opening for redirecting the contents of the can 12 into the spray nozzle 20. The spray nozzle 20 includes a corresponding sleeve 40 that fits over the projection 38 for attaching the spray nozzle 20 to the button 18.

As best seen in the sectioned views in FIGS. 16 and 17, the projection 38 connects to a valve sleeve 42 through an elbow passage 44 therebetween. The valve sleeve 42 is sized to mate with a valve 46 at the upper end of the can 12. The passage 44 enables the contents of the can 12 to pass from the valve 46, through the button 18, and into a spray passage 48 in the spray nozzle 20 as illustrated in FIG. 17.

The sprayer 14 is assembled by sliding the sleeve 40 over the projection 38 to fluidly connect the passages 44 and 48. The sprayer 14 may then be stored in the cap 10 by aligning the sprayer 14 along the recessed portion 16 with the button 18 oriented towards the wider end 22. The sprayer 14 is attached to the cap 10 by pressing the button 18 down upon the projection 26 such that the valve sleeve 42 slides over the projection 26 and the spray nozzle 20 is aligned with the notch 30 and, if applicable, resting on the support 28. As such, the projection 26 is sized similar to the valve 46 such that the button 18 can fit snugly upon either the projection 26 when being stowed, or the valve 46 when in use.

The cap 10 and sprayer assembly 14, as shown in FIG. 1, can be shipped to an assembly line to be secured atop a can 12. Since the recessed portion 16 completely contains the sprayer 14, the cap 10 is not affected when being rolled about itself in the normal fashion, and thus will work with existing tumbler machines. The cap 10 can be pressed onto a can 12 by applying pressure from above to the side portions 25. The side portions 25, which would normally be part of the top surface of the cap 10, are higher than the overall height of the sprayer 14 when seated on the projection 26 and support 28 and thus when applying a force to the cap 10 for assembling the cap 10 on the can 12, the risk of damaging the sprayer 14 is minimized or eliminated.

The sprayer 14 is also protected by the cap 10 during shipping, which minimizes the risk of losing the sprayer 14 before it can be sold, and eliminates interference with adjacent cans 12. Since aerosol cans 12 are typically shipped in an upright position, the completely stowed actuator 14 provides an advantage over traditional spray nozzles that are attached to the side of the can 12. When items protrude from the side of the can 12, they may fall off and/or interfere with each other during shipping. The stored sprayer 14 does not create such problems.

Figure 15:
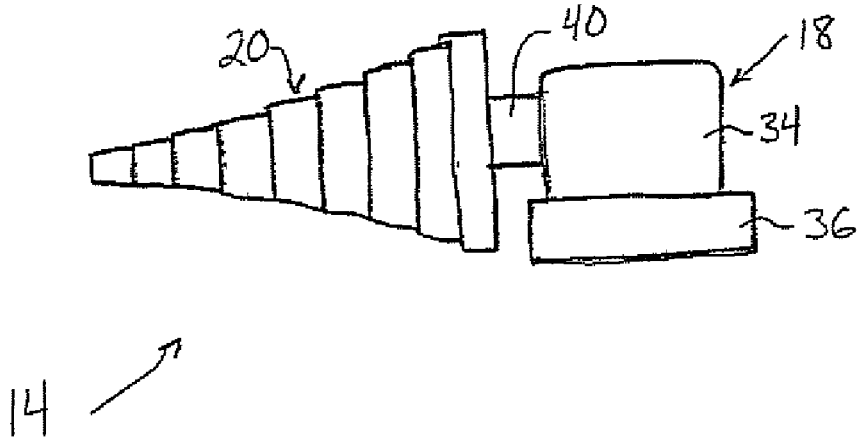
FIG. 15 is a side elevation view of the sprayer shown in FIG. 12.

In use, the cap 10 is first removed from the can 12 and then the sprayer 14 is detached from the recessed portion 16. The sprayer 14, with or without the spray nozzle 20, can then be attached to the valve 46 as shown in FIG. 15. The contents of the can 12 can be released by pressing the button 18. When the can 12 is later stored, the sprayer 14 may be removed from the can 12 and stored in the cap 10 and the cap 10 returned to the top of the can 12.

Figure 18:
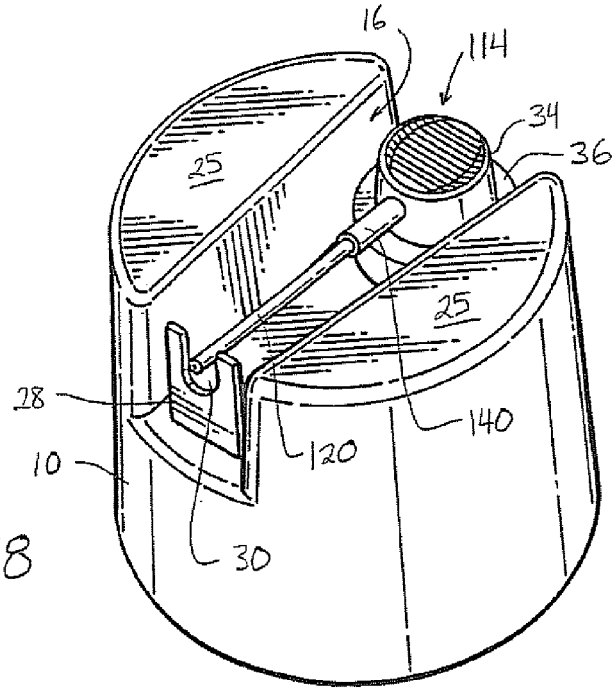
FIG. 18 is a perspective assembly view of another embodiment of a cap with recessed portion and stored sprayer.
Figure 2:
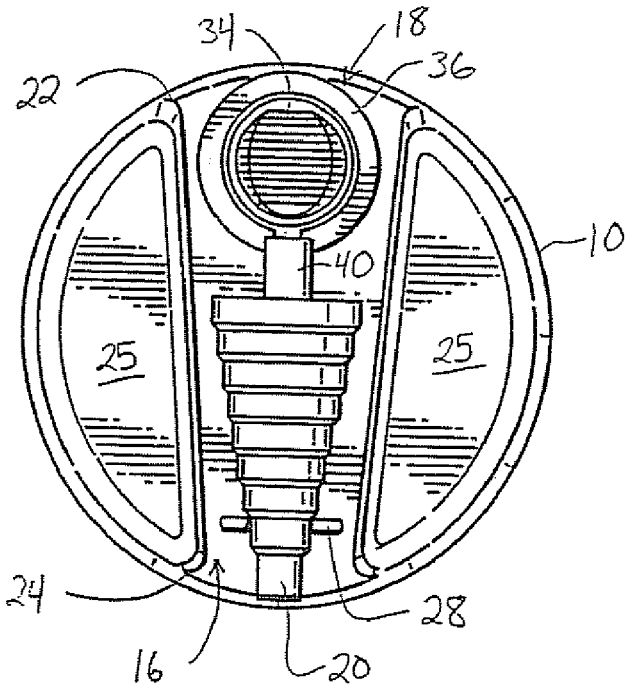
FIG. 2 is a top plan view of the embodiment of FIG. 1.
Figure 3:
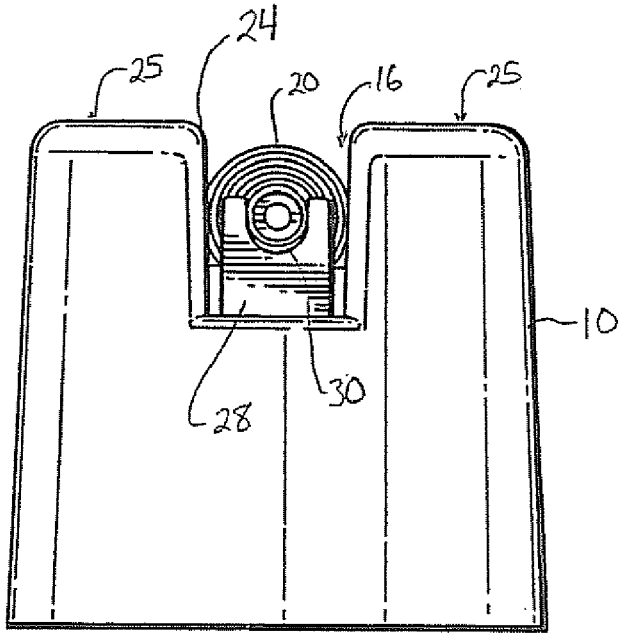
FIG. 3 is a front elevation view of the embodiment of FIG. 1.
Figure 4:
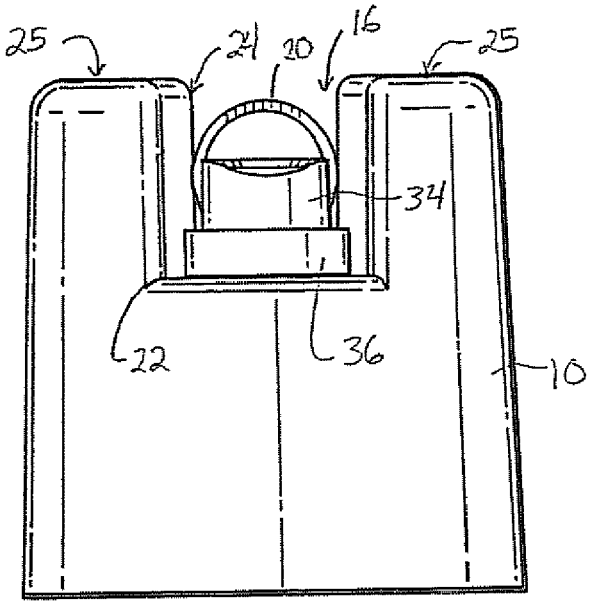
FIG. 4 is a rear elevation view of the embodiment of FIG. 1.
Figure 5:
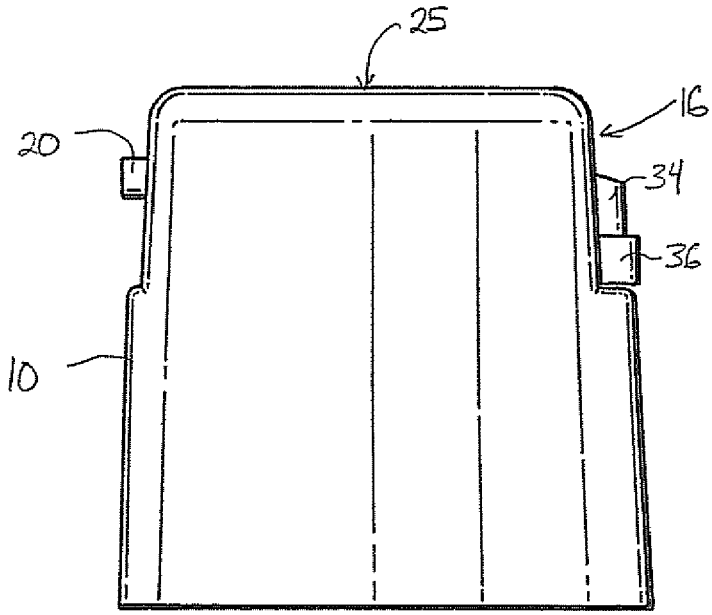
FIG. 5 is a side elevation view of the embodiment of FIG. 1.

Referring now to FIG. 18, another embodiment with a different sprayer 114 is shown. It will be appreciated that in FIG. 18, similar elements with respect to FIG. 1, are given identical numerals and modified elements with respect to FIG. 1, are given like numerals with the prefix "1". The sprayer 114 in FIG. 18 comprises the same button 18 shown in FIGS. 1-17, however it can be seen that a different spray nozzle 120 is used. The spray nozzle 120 comprises a sleeve 140 that is sized to fit over the projection 38. It can thus be appreciated that the button 18 can be designed to accommodate various types of spray nozzles 20, 120 for different products. As such, a common cap 10 and button 18 can be applied to multiple product lines using different spray nozzles 20, 120, cans 12, etc.

It can therefore be seen that the recessed portion 16 of the cap 10 enables the sprayer 14 to be stored within the cap 10 without interfering with adjacent cans 12 during shipping or adversely affecting the normal assembly process. The projection 26 and support 28 also provide a convenient way to retain and store the sprayer 14 between uses and does not require additional adhesive tape, or other methods of attaching the sprayer 14 to the can 12. It can also be seen that the button 18 accommodates the attachment of various spray nozzles 20 and therefore the cap 10 and button 18 can be adapted for different products.

Although the above aspects have been described with reference to certain specific embodiments, various modifications thereof will be apparent to those skilled in the art.

The invention claimed is:

1. A cap for an aerosol can, the cap comprising:

a first portion conforming to the rim of said aerosol can for securing said cap to said aerosol can; and a second portion extending from said first portion to completely cover a nozzle protruding from said can, said second portion comprising a recessed portion comprising an upwardly directed open face, the recessed portion being sized to completely contain an attachment to be used with said aerosol can, said recessed portion comprising a post to enable said attachment to be removably attached to the cap by insertion of the post into a complementary portion of the attachment, the post being positioned such that the attachment, when supported on the post, is completely contained within said recessed portion, without providing fluid communication between said nozzle and the attachment.

2. The cap according to claim 1 wherein said recessed portion defines a diametric channel through said second portion.

3. The cap according to claim 2 wherein said channel is tapered.

4. The cap according to claim 1 wherein said recessed portion comprises a raised support at one end for supporting a portion of said attachment.

5. The cap according to claim 4 wherein said raised support comprises a notch for aligning said portion of said attachment.

6. The cap according to claim 1 wherein said post is sized to fit in a fluid passage in said attachment.

7. The cap according to claim 6 wherein said recessed portion comprises a raised support at one end for supporting a first end of said attachment.

8. The cap according to claim 6 wherein said post is inset from the periphery of said cap to contain said attachment within said recessed portion and inhibit protrusion of said attachment beyond said periphery.

9. The cap according to claim 6 wherein said post is sized similar to an opening feeding said nozzle protruding from said can.

10. The cap according to claim 1 further comprising a sprayer device removably securable to said cap within said recessed portion.

11. The cap according to claim 10 wherein said sprayer device comprises a base for attaching said sprayer to said nozzle protruding from said can and a tubular nozzle extending from said base.

12. The cap according to claim 10 wherein said sprayer device comprises a base for attaching said sprayer to said nozzle protruding from said can and a tapered nozzle extending from said base.

13. The cap according to claim 11 wherein said sprayer device comprises an internal channel for redirecting the content of said can when said sprayer is attached to said can.

14. The cap according to claim 12 wherein said sprayer device comprises an internal channel for redirecting the contents of said can when said sprayer is attached to said can.

15. An aerosol can comprising the cap according to claim 1.

* * * * *